US011466488B2

(12) United States Patent
Gardner et al.

(10) Patent No.: US 11,466,488 B2
(45) Date of Patent: Oct. 11, 2022

(54) DOOR LATCH

(71) Applicants: Robert Paul Gardner, Weybridge (GB); Stephen Gardner, West Byfleet (GB)

(72) Inventors: Robert Paul Gardner, Weybridge (GB); Stephen Gardner, West Byfleet (GB)

( * ) Notice: Subject to any disclaimer, the term of this patent is extended or adjusted under 35 U.S.C. 154(b) by 218 days.

(21) Appl. No.: 16/790,911

(22) Filed: Feb. 14, 2020

(65) Prior Publication Data

US 2020/0263464 A1 Aug. 20, 2020

(30) Foreign Application Priority Data

Feb. 14, 2019 (GB) ..... 1902073

(51) Int. Cl.
*E05C 3/16* (2006.01)
*E05C 3/22* (2006.01)
(Continued)

(52) U.S. Cl.
CPC ..... *E05C 3/167* (2013.01); *E05B 15/006* (2013.01); *E05C 3/041* (2013.01); *E05C 3/22* (2013.01);
(Continued)

(58) Field of Classification Search
CPC ..... Y10T 292/1075; Y10T 292/1083; Y10T 292/1084; Y10T 292/1085; Y10T 292/1092; Y10T 292/14; Y10T 292/59; Y10T 292/96; E05C 3/167; E05C 3/22; E05C 3/00; E05C 3/004; E05C 3/02; E05C 3/04; E05C 3/041; E05C 3/044; E05C 3/12; E05C 3/14; E05C 3/145; E05Y 2900/112; E05Y 2900/132; E05B 65/0035; E05B 15/0053; E05B 15/006; E05B 15/008; E05B 2015/0066; E05B 13/002; E05B 13/004; Y10S 292/30
See application file for complete search history.

(56) References Cited

U.S. PATENT DOCUMENTS 873,185 A * 12/1907 Stratton ..... E05F 11/00 292/202
1,692,579 A * 11/1928 Schrader ..... E05C 3/145 292/241
(Continued)

FOREIGN PATENT DOCUMENTS

DE 3912483 A1 10/1990
EP 2565351 B1 * 3/2019 ..... E05B 15/006
(Continued)

*Primary Examiner* — Kristina R Fulton
*Assistant Examiner* — Steven A Tullia
(74) *Attorney, Agent, or Firm* — Dinsmore & Shohl LLP

(57) ABSTRACT

A latch is provided for latching the doors of cubicles or stalls provided in public washrooms. The latch includes a body mounted within a cavity formed between the inner and outer door surfaces, the body rotatably mounting a spindle having a latching member mounted at one end. Biasing means in the form of one or more cam followers acting on a corresponding number of cam surfaces is provided between the body and the spindle to hold the spindle in a closed position but, once displaced from the closed position, to bias the spindle toward a fully open position.

11 Claims, 2 Drawing Sheets

(51) Int. Cl.
*E05B 15/00* (2006.01)
*E05C 3/04* (2006.01)

(52) U.S. Cl.
CPC ... *E05Y 2900/112* (2013.01); *E05Y 2900/132* (2013.01)

(56) References Cited

U.S. PATENT DOCUMENTS 1,798,148 A * 3/1931 Ekman ..... E05C 3/145 292/332
2,505,858 A * 5/1950 Hagstrom ..... E05C 3/167 292/224
4,988,136 A * 1/1991 Gressett, Jr. ..... E05B 3/065 292/244
5,022,690 A * 6/1991 Coltrin ..... E05B 63/121 292/21
5,147,331 A * 9/1992 Rust ..... E05C 3/145 292/205
5,205,596 A * 4/1993 Ralph ..... E05B 3/065 292/224
5,529,354 A * 6/1996 Studt ..... E05B 3/065 292/163
5,765,883 A 6/1998 Dessenberger et al.
2003/0110819 A1* 6/2003 Sadler ..... E05B 13/004 70/210
2006/0196234 A1* 9/2006 Dolev ..... E05B 9/08 70/56
2006/0220396 A1* 10/2006 Ellis ..... E05B 3/00 292/336.3
2006/0261609 A1* 11/2006 Flott ..... E05B 13/005 292/336.3
2008/0012360 A1* 1/2008 Engel ..... E05B 15/0053 292/252
2012/0313387 A1 12/2012 Liang et al.
2014/0035298 A1 2/2014 Glickman
2016/0348411 A1 12/2016 Liau

FOREIGN PATENT DOCUMENTS

FR 2900680 A1 * 11/2007 ..... E05B 15/0053
GB 2297798 A * 8/1996 ..... E05B 41/00
KR 20140087532 A * 7/2014 ..... E05B 15/006
KR 200474013 Y1 * 8/2014
KR 200482850 Y1 * 3/2017
KR 20180080471 A * 7/2018

* cited by examiner

DOOR LATCH

CROSS-REFERENCE TO RELATED APPLICATION

This application claims priority from GB1902073.4 filed Feb. 14, 2019, the entire content of which is incorporated herein by reference.

FIELD OF THE INVENTION

This invention relates to a door latch and, in particular, to a door latch suitable for latching doors in of cubicles or stalls located in public and/or commercial washrooms.

BACKGROUND OF THE INVENTION

As is well known, public washrooms typically include individual toilet cubicles or stalls formed by a series of spaced side panels fixed at right angles to a wall of the washroom, each cubicle being closed by a front assembly that includes a door hinged to, or adjacent to, one of the side panels; and a latch mounted on the door which engages with a socket mounted on or adjacent to the opposite side panel. Given the high volume of use of such facilities the hardware incorporated in these facilities is subjected to wear and tear. One example of wear and tear is damage to the door latches arising from the door being moved to a closed position when the latch is not restrained in a fully open state. As a result, the latching bar may impact against the outer surface of the socket and become bent or broken.

It is an object of this invention to provide a door latch for a cubicle or stall which will go at least some way to addressing the shortcoming described above; or which will at least offer a novel and useful alternative.

SUMMARY OF THE INVENTION

Accordingly, the invention provides a latch for a door having inner and outer facing surfaces, said latch comprising a body configured for mounting within a cavity in the door extending between said inner and outer surfaces; a spindle rotatably mounted in the body for rotation about a spindle axis between two defined positions; a latch member fixed to the spindle for rotation therewith; wherein said latch further comprises biasing means configured to retain said spindle in a first defined position but, when the spindle is released from the first defined position, the biasing means is operable to bias rotation of the spindle about the spindle axis to the second defined position, the biasing means acting between the spindle and the body and being arranged substantially along one or more radii extending from the spindle axis.

Preferably the body is substantially symmetrical about the spindle axis.

Preferably when viewed along the spindle axis, the body is an annulus having inner and outer circumferential surfaces, and wherein the biasing means is confined within the outer circumferential surface.

Preferably the two defined positions are spaced 90° apart.

Preferably the biasing means comprises at least one cam surface formed in or on the spindle, and at least one cam follower mounted in the body, the cam follower being biased into contact with said cam surface.

Preferably the biasing means comprises a plurality, preferably three, cam surfaces and a corresponding number of cam followers.

Preferably the cam surfaces and the cam followers are respectively spaced equally about the spindle axis.

Preferably the latch member is fixed on or adjacent to an end of the spindle.

Preferably the latch member comprises an elongate rod having a distal end formed of a softer material than the remainder of said rod.

Preferably the latch further includes sealing members engageable with the body and configured to sealingly engage between the body and the inner and outer facing surfaces respectively.

Preferably the latch is provided with a damping facility operable to damp rotation of the spindle within the body.

Many variations in the way the invention may be performed will present themselves to those skilled in the art, upon reading the following description. The description should not be regarded as limiting but rather as an illustration, only, of one manner of performing the invention. Subject to the scope of the appended claims, where appropriate any element or component should be taken as including any or all equivalents thereof whether or not specifically mentioned.

BRIEF DESCRIPTION OF THE DRAWINGS

One working embodiment of the invention will now be described with reference to the accompanying drawings in which.

DETAILED DESCRIPTION OF THE INVENTION

Figure 1:
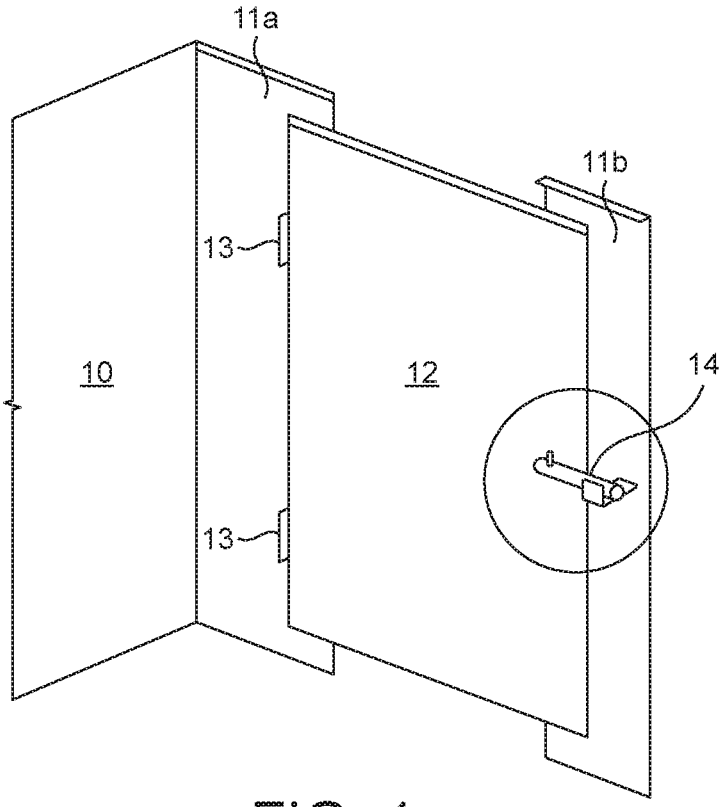
FIG. 1 shows a schematic isometric view, from the inside, of a typical washroom cubicle or stall in which a latch according to the invention may be used.

The invention has been devised, in particular, to provide a latch for doors forming part of cubicles or stalls in public washrooms, hereafter both being referred to as cubicles. As shown in FIG. 1 a typical cubicle is comprised of a pair of spaced side wall panels, one of which is shown at 10, the side wall panels being mounted to extend perpendicularly from a wall (not shown) of the washroom. In the example shown the front of the cubicle is defined by spaced fascia panels 11*a* and 11*b*, and a door 12. The door 12 is mounted to one of the fascia panels 11*a* by hinges 13 so as to swing into the cubicle and, in use, may be latched to the other fascia panel 11*b* in a closed position by a latch 14 circled in FIG. 1 and described in greater detail below.

Figure 2A:
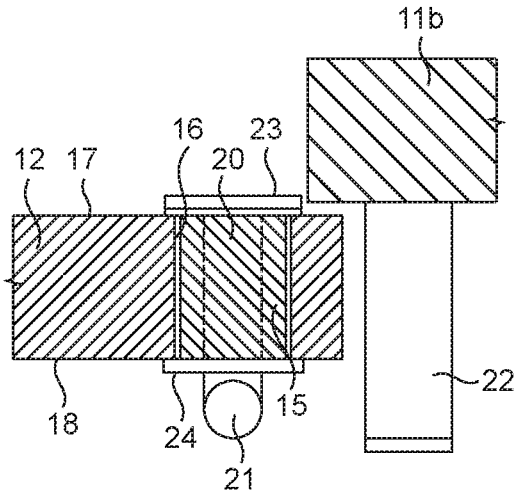
FIG. 2A shows a vertical cross-section of that which is circled in FIG. 1, with the latch in an open position.
Figure 2B:
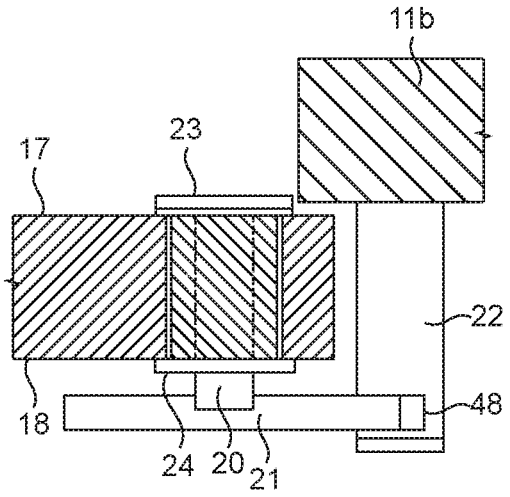
FIG. 2B shows that which is shown in FIG. 1 but with the latch in a closed position.

As can be seen more clearly in FIGS. 2A and 2B, the latch comprises a body 15 that is accommodated in a bore 16 extending through the door panel between an outer surface 17 and an inner surface 18 of the door. A spindle 20 is rotatably mounted within the body 15, a latch member 21 being fixed on the inner end of the spindle and extending in a direction substantially perpendicular to the spindle axis.

Carried by the spindle 20, the latch member 21 rotates between an open position shown in FIG. 2A and a closed position 2B. In the closed position, the latch member 21 can engage in a socket 22 mounted on the inner surface of fascia panel 11*b*.

Also shown in FIGS. 2A and 2B are sealing members 23 and 24 which attach to the body 15, form seals between the body and the door surfaces 17 and 18 respectively, and thus prevent often corrosive cleaning materials used on washrooms from entering the body 15 and damaging the operating parts of the latch.

Figure 3:
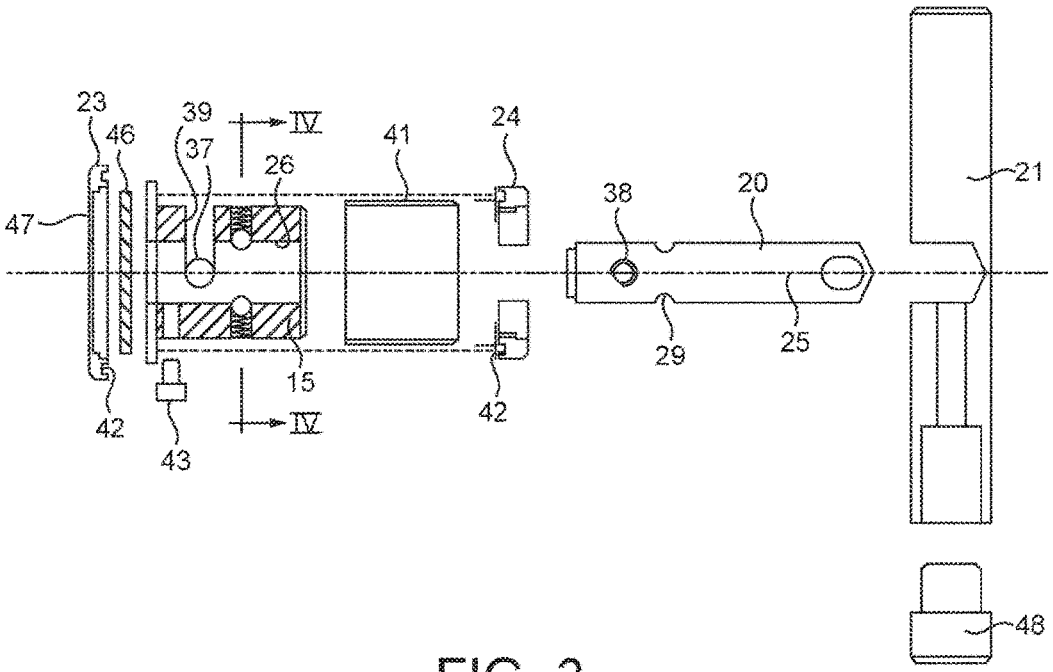
FIG. 3 shows an exploded view of various components, partly in cross-section, forming a latch according to the invention.

Turning now to FIG. 3, latch body 15 has a bore 26 extending there-through in which spindle 21 rotates about spindle axis 25. When viewed in cross-section as in FIGS. 4A and 4B, it can be seen that the body is conveniently of a regular shape and, in the case of the embodiment depicted, is annular in cross-section having an outer surface 27 and an inner surface 28.

In accordance with the invention biasing means, partly formed in the spindle 20 and partly provided in the body 15, bias rotation of the spindle 20 about the spindle axis 25. Thus the latch can be spring-loaded towards a fully-open position as shown in FIG. 2A to minimise the possibility of a partially open latch colliding with the door surround, or outer surface of the locking socket 22, and becoming damaged.

Figure 4A:
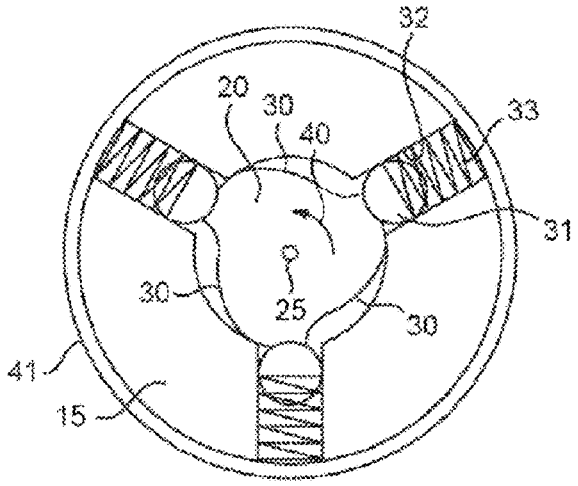
FIG. 4A shows an enlarged view along the line IV-IV in FIG. 1, which the latch components assembled and placed in a closed or locking position.
Figure 4B:
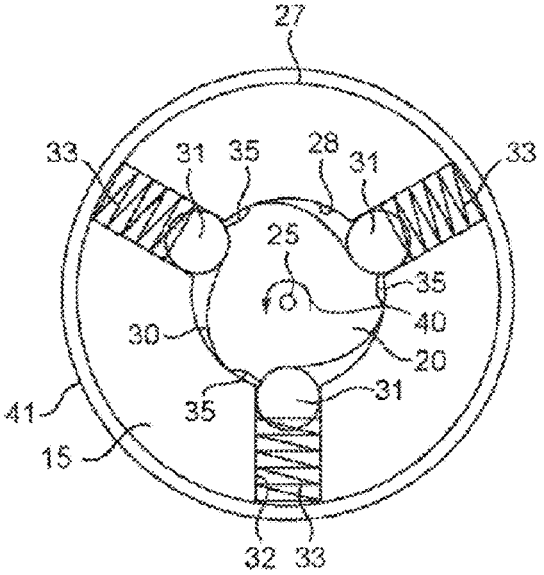
FIG. 4B shows a similar view to FIG. 2A but with the latch in an open position.

In the embodiment shown in FIGS. 3, 4A and 4B the biasing means are provided in part by a plurality of, preferably three, cam surfaces 30 formed in a groove 12 extending about the periphery of spindle 20. A corresponding three moveable cam followers 31 are mounted within the body, confined within the outer surface 27 of the body, and are biased into contact with the cam surfaces. As can be seen, the cam followers 31 comprise ball bearings sliding in bores 32 formed in the body 15, the ball bearings 31 being biased into contact with the cam surfaces 30 by coil springs 33. The bores 32 are, preferably aligned substantially along radii extending from the swivel axis 8. And are preferably equally spaced about the spindle axis 25.

From FIGS. 4A and 4B, it can be seen that the cam surfaces formed in groove 31 of the spindle are separated by three concave detents 35 which are shaped to correspond to the peripheries of ball bearings 31. When the latch is in the locked position as shown in FIG. 4A, each of the ball bearings 31 rests in a detent 35. The locked position is also preferably defined by a locking pin 37 which is fixed through hole 38 in the spindle and bottoms out in channel 39 in the body when the latch is in the closed position.

As the spindle is moved in the direction of arrow 40 toward an open position, the ball bearings 31 are displaced out of detents 35 and the biasing action of springs 33 then displaces each bearing along its respective cam surface 30 to the full open position shown in FIGS. 2A and 4B. Due to the open position being defined by the maximum depths of the cam surfaces 30 in groove 31, the latch is maintained in the fully open position until the spindle is manually reversed, against the bias imposed by springs 33, until the bearings 31 are once again seated in detents 35. The springs 33 may conveniently be retained within the body 15, against the bearing followers 31, by a sleeve 41 fitted over the outer surface 27 of the body 15. The cam surfaces 30 and detents 35 are preferably configured such that the degree of rotation between the closed and fully-open positions shown in FIGS. 4A and 4B respectively is 90°.

As is also shown in FIG. 1, sealing members 23 and 24 preferably include peripheral grooves 42 on their door contact faces to locate and retain 0-ring seals. As stated above, this helps to isolate the working parts of the latch from dirt as well as from cleaning chemicals typically used in washrooms.

In the example shown, the sleeve 41 is fixed to the body 15 by a headed machine screw 43, the head of the screw conveniently locating in a groove (not shown) extending axially along the wall defining the mounting bore 16 in the door so as to prevent rotation of the latch assembly in the door. The sleeve 41 may also serve to retain a 'smart' grease within the assembly which fills the clearance between the body 15 and the spindle 20 and acts as a damper to the rotating action, thus providing a 'soft' opening action.

In keeping with latches used in washroom applications, an indicator disc 46 is preferably provided which is fixed to the outer end of the spindle 20 and rotates with the spindle to indicate if the latch is open or closed. The indicator disc is preferably sealed within the latch and is visible through window 47 provided in sealing member 23.

Finally, FIG. 1 illustrates the use of a button 48 on the distal end 10 of the latch member 21. The button 48 is preferably formed from a softer material, such as plastics, than the latching member so that in the event of an impact being applied to the latching member, the button 48 will distort or break, thus minimising or avoiding damage to the latch itself.

The invention claimed is:

1. A latch for a door having inner and outer facing surfaces, said latch comprising:

a body configured for mounting within a cavity in the door extending between the inner and outer surfaces;

a spindle rotatably mounted in the body for rotation about a spindle axis between a fully open position and a closed position, the fully open and closed positions being rotationally spaced with respect to the spindle axis;

a latch member fixed to the spindle for rotation therewith; and a biasing means configured to respectively retain said spindle in both the closed and fully open positions but, when the spindle is released from the closed position, the biasing means being operable to cause rotation of the spindle about the spindle axis from the closed position to the fully open position, the biasing means acting between the spindle and the body and comprising at least one cam surface extending between the fully open position and the closed position and at least one cam follower biased into contact with the cam surface, the at least one cam follower being arranged substantially along one or more radii extending from the spindle axis.

2. The latch according to claim 1, wherein the body is substantially symmetrical about the spindle axis.

3. The latch according to claim 2, wherein, when viewed along the spindle axis, the body is an annulus having inner and outer circumferential surfaces, and wherein the biasing means is confined within the outer circumferential surface.

4. The latch according to claim 1, wherein the fully open position and the closed position are spaced 90° apart.

5. The latch according to claim 1, to wherein the biasing means comprises the at least one cam surface formed in or on the spindle, and the at least one cam follower mounted in the body.

6. The latch according to claim 5, wherein the at least one cam surface and at least one cam follower comprise a plurality of cam surfaces and a corresponding number of cam followers.

7. The latch according to claim 6, wherein the plurality of cam surfaces comprises three cam surfaces.

8. The latch according to claim 6, wherein the cam surfaces and the cam followers are respectively spaced equally about the spindle axis.

9. The latch according to claim 1, wherein the latch member is fixed on or adjacent to an end of the spindle.

10. The latch according to claim 1, wherein the latch member comprises an elongate rod having a distal end formed of a softer material than a remainder of said rod.

11. The latch according to claim 1, further including sealing members engageable with the body and configured to sealingly engage between the body and the inner and outer facing surfaces respectively.

* * * * *